US010532587B2

(12) United States Patent
Ohnishi

(10) Patent No.: US 10,532,587 B2
(45) Date of Patent: Jan. 14, 2020

(54) PRINTING APPARATUS AND PRINTING METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/181,363

(22) Filed: Nov. 6, 2018

(65) Prior Publication Data

US 2019/0143715 A1 May 16, 2019

(30) Foreign Application Priority Data

Nov. 16, 2017 (JP) ..... 2017-221349

(51) Int. Cl.

| | |
|---|---|
| ***B41J 29/38*** | (2006.01) |
| ***B41J 11/00*** | (2006.01) |
| ***B41J 2/21*** | (2006.01) |
| ***B41M 7/00*** | (2006.01) |

(52) U.S. Cl.

CPC ..... *B41J 11/002* (2013.01); *B41J 2/2107* (2013.01); *B41M 7/009* (2013.01); *B41M 7/0081* (2013.01)

(58) Field of Classification Search

CPC ..... B41J 2/2107; B41J 11/002; B41M 7/009; B41M 7/0081

See application file for complete search history.

(56) References Cited

U.S. PATENT DOCUMENTS

2013/0063524 A1* 3/2013 Katoh ..... B41J 2/135 347/44
2015/0290951 A1* 10/2015 Furuhata ..... B41J 11/002 428/195.1
2016/0068697 A1* 3/2016 Toda ..... C09D 175/04 347/100
2018/0370253 A1* 12/2018 Ohnishi ..... B41J 2/01
2019/0126656 A1* 5/2019 Veis ..... B41F 23/045

FOREIGN PATENT DOCUMENTS

WO 2017135425 8/2017

OTHER PUBLICATIONS

"Search Report of Europe Counterpart Application", dated Mar. 27, 2019, p. 1-p. 7.

* cited by examiner

*Primary Examiner* — Julian D Huffman
(74) *Attorney, Agent, or Firm* — JCIPRNET

(57) ABSTRACT

The printing apparatus performs inkjet printing and includes an inkjet head that ejects ink to a medium, and an ultraviolet irradiator that irradiates the ink on the medium with ultraviolet light so as to heat the ink. The ink contains solvents. The solvents include a low-boiling solvent and a high-boiling solvent having a higher boiling point than the other, and the ink contains 20 wt. % or more of the low-boiling solvent and 20 wt. % or more of the high-boiling solvent. In at least part of a duration of time until the solvents in the ink are completely evaporated, an energy line irradiator irradiates the ink on the medium with an energy line, so that a temperature of the ink on the medium increases to a degree higher than or equal to the boiling point of the low-boiling solvent and lower than the boiling point of the high-boiling solvent.

13 Claims, 7 Drawing Sheets

PRINTING APPARATUS AND PRINTING METHOD

CROSS REFERENCE TO RELATED APPLICATIONS

This application claims the priority benefit of Japanese Patent Application No. 2017-221349, filed on Nov. 16, 2017. The entirety of the above-mentioned patent application is hereby incorporated by reference herein and made a part of this specification.

TECHNICAL FIELD

This disclosure relates to a printing apparatus and a printing method.

DESCRIPTION OF THE BACKGROUND ART

Conventionally, printing apparatuses that perform inkjet printing (inkjet printers) are used for various purposes. It is discussed in recent years to use instantaneous drying inks in inkjet printing methods using inkjet printers. The instantaneous drying inks are dried by being irradiated with an energy line such as ultraviolet light (for example, WO 2017-135425).

SUMMARY

Instantaneous drying inks that are very quickly dried may be prevented from bleeding on a target medium. Therefore, a high-resolution print result may be obtained with mediums conventionally involving a very high risk of ink bleeding. Yet, the instantaneous drying ink is a material recently developed. It is desirable, therefore, to find more suitable compositions of and more efficient drying methods for inks of this type. This disclosure provides a printing apparatus and a printing method that may fulfill such needs.

The inventors of this disclosure, as a result of keen studies, experiments, and discussions on various technical means for use of the instantaneous drying inks, found out that very short drying time of such inks may lead to other technical issues. When the instantaneous drying ink is used with, for example, a non-permeable medium such as plastic medium (for example, glossy medium), the ink may be prevented from bleeding by being irradiated with an energy line (for example, ultraviolet light) immediately after landing on the medium. However, the ink thus instantaneously heated may be dried before dots of the ink are sufficiently flattened and may accordingly have an uneven surface. The energy line, if radiated in excess, may cause bumping of the ink. A surface of the ink thus boiled may form a porous coating film. As a result, a surface of a printed matter may lose desirable glossiness.

To prevent the ink surface from becoming porous and accordingly rough, it may be suggested to irradiate the ink with a small amount of ultraviolet light to dry the ink slowly. This, however, may increase a risk of ink bleeding and may undermine some or all of the merits of the instantaneous drying ink. When a pigment is added to this ink as colorant, the pigment may possibly be ununiformly dispersed in the ink yet to be dried, which is generally called coffee stain effect. Thus, taking time to dry the ink alone cannot be a solution and may lead to other issues.

The inventors of this disclosure discussed any other effective methods for drying the instantaneous drying ink but such time-invested means. Then, they came up with the idea of using ink containing solvents having different boiling points to make use of a difference between the boiling points when drying the ink. They further found out that such ink may help to address the various issues of the known art described earlier. They further studied and discussed technical means and aspects necessary to make the best use of such ink, and finally accomplished the following apparatus and method.

This disclosure provides a printing apparatus that performs inkjet printing on a medium. The printing apparatus includes: an inkjet head that ejects ink to the medium, and an energy line irradiator that irradiates the ink on the medium with the energy line so as to heat the ink. The ink contains solvents of at least two types having boiling points that differ from each other. The solvents include a low-boiling solvent having a lower boiling point than the other and a high-boiling solvent having a higher boiling point than the other, and the ink contains 20 wt. % or more of the low-boiling solvent and 20 wt. % or more of the high-boiling solvent. In at least part of a duration of time until the solvents in the ink are completely evaporated after the ink land on the medium, the energy line irradiator irradiates the ink on the medium with the energy line, so that a temperature of the ink on the medium increases to a degree higher than or equal to the boiling point of the low-boiling solvent and lower than the boiling point of the high-boiling solvent.

According to this configuration, the ink is heated until a temperature is reached that is higher than or equal to the boiling point of the low-boiling solvent and lower than the boiling point of the high-boiling solvent. This may allow the low-boiling solvent to be adequately dried, while reducing a rate of evaporation of the high-boiling solvent. Then, the ink may be increased in viscosity and thereby prevented from bleeding on the medium. In this configuration, the high-boiling solvent left unevaporated in the ink may cause the ink dots to flatten and thereby serve to prevent the ink surface from becoming uneven. In at least part of the duration of time, the energy line irradiator may irradiate the ink on the medium with the energy line so that the ink is increased in viscosity to an extent that the ink does not bleed on the medium but is allowed to flatten over time. This may allow the ink dots to be sufficiently flattened, with a reduced risk of ink bleeding. By keeping the ink to stay at a temperature lower than the boiling point of the high-boiling solvent, bumping of the ink or the like may be prevented, and the surface of the ink may be unlikely to form a porous coating film. When the ink is dried by being irradiated with the energy line, such unfavorable events as ink bleeding and roughened ink surface may be both prevented.

In this configuration, the ink may be a type of ink that leaves resin on the medium after being dried. In case the ink is irradiated with powerful energy line in short time to be instantaneously dried, a surface of resin remaining on the medium may be roughened, and a glossy print result may be difficult to obtain. When such ink is used, the technical means described earlier may avoid roughening the resin surface, imparting desirable glossiness to a printed matter. In this configuration, the ink may contain a pigment as colorant. In case the ink is irradiated with powerful energy line in short time to be instantaneously dried, the pigment may be unnecessarily disturbed, and a glossy print result may be difficult to obtain. When the ink is slowly dried, on the other hand, the generally called coffee stain effect may be more likely to occur. The technical means described earlier, however, may sufficiently increase the viscosity of the ink immediately after landing on the medium to an extent that the ink is not fully dried. Thus, the pigment-containing ink may be more reliably fixed to the medium.

In this configuration, the energy line irradiator may radiate ultraviolet light as the energy line. This configuration may be a suitable example of the energy line used to heat the ink. Further, the ink may contain solvents of three or more different types. In this instance, the high-boiling solvent and the low-boiling solvent are preferably two solvents added to the ink in larger contents than the other solvent(s). The high-boiling solvent is preferably a solvent having a boiling point higher by 30° C. or more than the boiling point of the low-boiling solvent. For example, the boiling point of the low-boiling solvent may be a temperature lower than or equal to 110° C., and the boiling point of the high-boiling solvent may be a temperature higher than or equal to 130° C. In another example, the boiling point of the low-boiling solvent may be a temperature higher than or equal to 60° C. and lower than 100° C., and the boiling point of the high-boiling solvent may be a temperature higher than or equal to 100° C. The ink may be heated as desired by setting the boiling points of the respective solvents to stay in the foregoing temperature ranges. In this configuration, the low-boiling solvent at 25° C. preferably has a vapor pressure four or more times larger than that of the high-boiling solvent at 25° C. After 80% or more of the low-boiling solvent included in the ink is evaporated, the ink preferably has a degree of viscosity greater than or equal to 100 mPa·sec. The printing operation may be more suitably carried out by using the low-boiling solvent and the high-boiling solvent thus configured. The energy line irradiator preferably includes a UVLED (UV-LED) as the energy line irradiating means, because such means may allow an intensity of the energy line to be easily regulated by simple ON/OFF control in response to timings of suspending the printing, regions on the medium should be irradiated with the energy line, or the like. Other than the UVLED, the energy line irradiating means is preferably a semiconductor laser, or may be a metal halide lamp for certain printing requirements.

In this configuration, another heating treatment may be additionally performed to fully dry the ink after the ink is heated by the energy line to a temperature higher than or equal to the boiling point of the low-boiling solvent and lower than the boiling point of the high-boiling solvent, or the energy line may also be used to fully dry the ink. Specifically, the energy line irradiator may irradiate the ink that landed on the medium with the energy line under a first condition and a second condition until all of the solvents in the ink are evaporated. The first condition may be heating the ink on the medium so as to reach a temperature higher than or equal to the boiling point of the low-boiling solvent and lower than the boiling point of the high-boiling solvent. The second condition may be heating the ink on the medium so as to reach a temperature higher than or equal to the boiling point of the high-boiling solvent at a certain point in at least part of timings. The energy line irradiator irradiates the ink on the medium with the energy line under the first condition and accordingly evaporates 50% or more of the low-boiling solvent included in the ink. After the energy line irradiation under the first condition, the energy line irradiator irradiates the ink on the medium with energy line under the second condition, and may accordingly further evaporate the high-boiling solvent to an extent that the ink is fixable to the medium. When the ink is irradiated with the energy line under the first condition, 80 wt. % or more of the low-boiling solvent is preferably evaporated from the ink. As a result, the ink that just landed on the medium may be effectively increased in viscosity.

Any other means but the energy line irradiation may be employed to fully dry the ink, a possible example of which is heating the ink using one or more selected from various heaters that heats the medium to dry the ink indirectly through the heated medium. This may also be an effective means for evaporating the high-boiling solvent included in the ink to an extent that the ink is fixable to the medium. The scope of this disclosure may include a printing method technically characterized similarly to the printing apparatus described so far. Such a printing method may provide effects similar to the effects described earlier.

Effects of the Invention

This disclosure may improve an efficiency of drying ink, for example, when the ink is dried by being irradiated with an energy line.

BRIEF DESCRIPTION OF THE DRAWINGS

FIG. 7 including FIG. 7A is a drawing of principal structural elements, illustrated by way of an example, of the printing apparatus 10. FIG. 7B is a drawing of conditions for ultraviolet irradiation using light sources 202*a* and 202*b* of an ultraviolet irradiator 104.

DETAILED DESCRIPTION OF EMBODIMENTS

Figure 1:
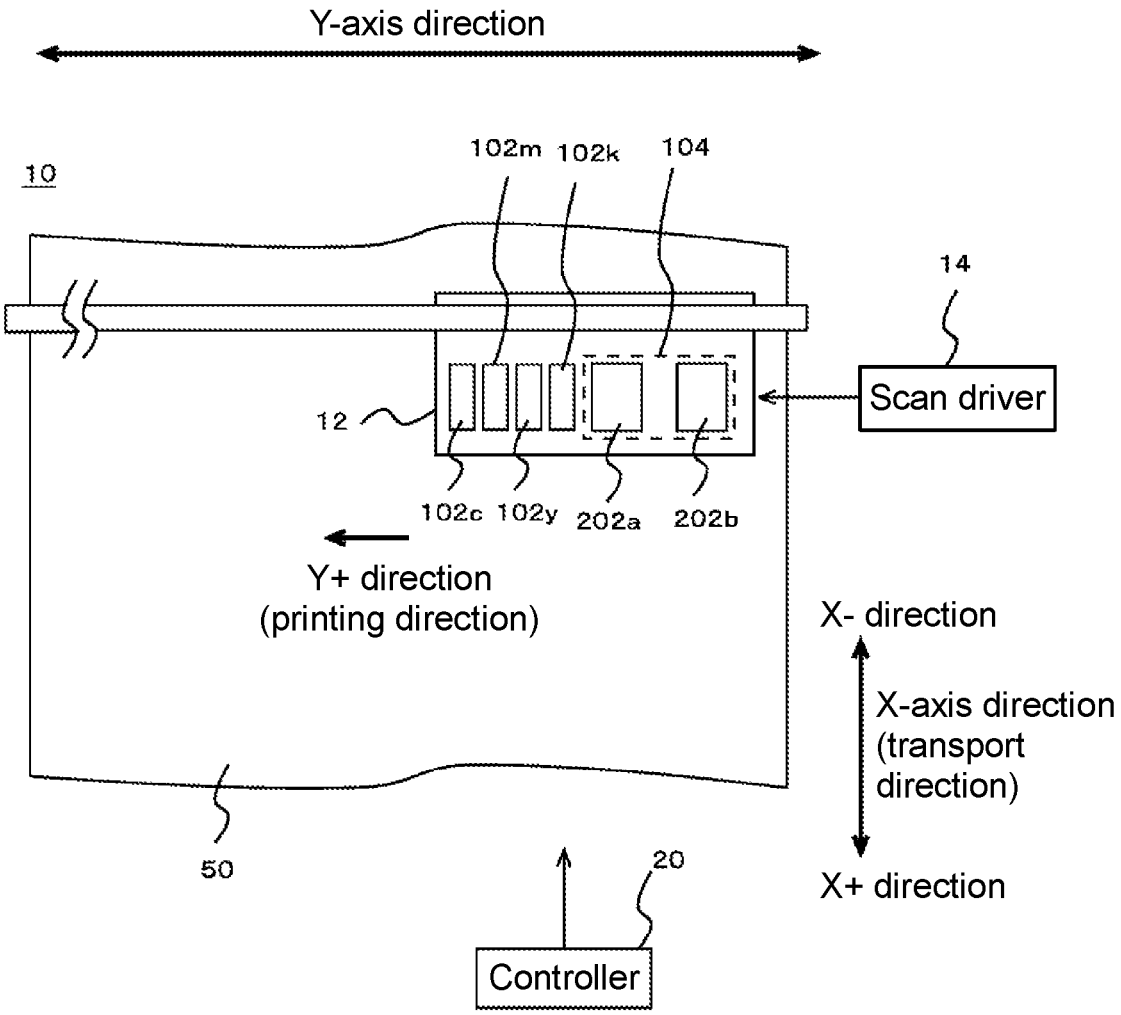
FIG. 1 is an upper view of a printing apparatus 10 according to an embodiment of this disclosure, illustrating principal structural elements by way of an example.

Hereinafter, embodiments of this disclosure are described in detail with reference to the accompanying drawings. FIG. 1 is an upper view of a printing apparatus 10 according to an embodiment of this disclosure, illustrating principal structural elements by way of an example. In this embodiment, the printing apparatus 10 is an inkjet printer that performs inkjet printing. The printing apparatus 10 includes a head unit 12, a scan driver 14, and a controller 20. Except for technical aspects hereinafter described, the printing apparatus 10 may be configured identically or similarly to the known inkjet printers. In addition to the technical aspects described in FIG. 1, the printing apparatus 10 may further include any known means that may be required for the printing operation.

In this embodiment, the printing apparatus 10 is a serial inkjet printer that prompts the head unit 12 to perform main scans. The main scan may be an operation in which the head unit 12 ejects ink (droplets) while moving in a preset main scanning direction (Y-axis direction in the drawing). Prompting the head unit 12 to perform main scans is specifically prompting inkjet heads of the head unit 12 to perform main scans.

The head unit 12 ejects inks to a print target medium 50 and has a plurality of inkjet heads and an ultraviolet irradiator 104. The plurality of inkjet heads include, as illustrated in the drawing, inkjet head 102*c*, inkjet head 102*m*, inkjet head 102*y*, and inkjet head 102*k* (hereinafter, inkjet heads 102*c-k*). In this embodiment, the inkjet heads 102*c-k* are arranged next to one another in the main scanning direction, with their positions aligned in a sub scanning direction (X-axis direction in the drawing) orthogonal to the main scanning direction. The inkjet heads 102*c-k* respectively eject different color inks, specifically, ejects inks having process colors used for full color expression (color inks). The inkjet head 102*c* ejects cyan color (C color) ink. The inkjet head 102*m* ejects magenta color (M color) ink. The inkjet head 102*y* ejects yellow color (Y color) ink. The inkjet head 102*k* ejects black color (K color) ink.

In this embodiment, the inks ejected from the inkjet heads 102*c-k* are each evaporation-drying ink. The evaporation-drying ink refers to ink fixable to the medium 50 through evaporation of a solvent(s) included in the ink. The solvent is a liquid material added to the ink to dissolve or disperse other components of the ink. Suitable examples of the solvent may be aqueous solvents and other suitable solvents (organic solvents). The evaporation-drying ink used in this embodiment generates heat by being irradiated with an energy line. When the ink generates heat under an energy line irradiation, the ink, for example, absorbs the energy line and thereby generates heat.

The energy line used in this embodiment is ultraviolet light. The ink used in this embodiment may at least contain a colorant, an ultraviolet absorbent, and a solvent. In this instance, the ultraviolet absorbent is a material that generates heat through absorption of ultraviolet light. The material that generates heat through absorption of ultraviolet light may refer to a material that converts radiated ultraviolet energy into thermal energy. Examples of the ultraviolet absorbent may include special materials prepared for heat generation in response to ultraviolet light. For example, the ultraviolet absorbent may be added to any one of vehicles included in the ink. The ultraviolet absorbent thus characterized may be a suitable one selected from the known ultraviolet absorbents. The ultraviolet absorbent may be one of the other additives added to the ink. When, for example, any one of ink components (colorant, resin, solvent or the like included in the ink) is a material that abundantly absorbs ultraviolet light, such component may serve as the ultraviolet absorbent, in which case an additional ultraviolet absorbent may be unnecessary. The ink may further contain other materials depending on a demanded printing quality or purpose. For example, the ink may further contain a binder resin.

The ink used in this embodiment contains at least two solvents having boiling points that differ from each other. Specifically, the ink may contain, as the two solvents having different boiling points, 20 wt. % or more of a low-boiling solvent having a lower boiling point than the other and 20 wt. % or more of a high-boiling solvent having a higher boiling point than the other. This embodiment dries the ink by leveraging such composition of the solvent-containing ink. Specific features of the ink and means for drying the ink will be described later in further detail.

The ultraviolet irradiator 104 of the head unit 12 according to this embodiment is an example of an energy line irradiator. The ultraviolet irradiator 104 irradiates the ink on the medium 50 with ultraviolet light which is an example of the energy line, and thereby heats the ink on the medium 50. In this embodiment, the ultraviolet irradiator 104 includes a plurality of light sources 202*a* and 202*b*. As illustrated in the drawing, the light sources 202*a* and 202*b* are aligned with the inkjet heads 102*c-k* in the sub scanning direction and are positioned behind the inkjet heads 102*c-k* during main scans. These light sources are arranged in the main scanning direction, so that the light source 202*a* is closer to the inkjet heads 102*c-k* and the light source 202*b* is distant from the inkjet heads 102*c-k*.

In this embodiment, the light sources 202*a* and 202*b* respectively irradiate the ink with ultraviolet light under different irradiating conditions. Specifically, the light source 202*a* in this embodiment radiates ultraviolet light under an irradiating condition 1 which is a preset first condition. The irradiating condition 1 is heating the ink on the medium 50 so as to reach a temperature higher than or equal to the boiling point of the low-boiling solvent and lower than the boiling point of the high-boiling solvent. On the other hand, the light source 202*b* radiates ultraviolet light under an irradiating condition 2; which is a preset second condition that differs from the irradiating condition 1. The irradiating condition 2 is heating the ink on the medium 50 so as to reach a temperature higher than or equal to the boiling point of the high-boiling solvent at a certain point in at least part of timings.

The irradiating condition 1 may be rephrased as radiating a relatively weak ultraviolet light. The irradiating condition 2 may be rephrased as radiating a relatively powerful ultraviolet light. The ultraviolet irradiator 104 radiates ultraviolet light from the light sources 202*a* and 202*b* during main scans and irradiates the ink that landed on the medium 50 with ultraviolet light under the irradiating condition 1, followed by the irradiating condition 2, until all of the solvents included in the ink are evaporated. After the ink is heated to a temperature higher than or equal to the boiling point of the low-boiling solvent and lower than the boiling point of the high-boiling solvent, the ink is further heated to be fully dried.

In this embodiment, the light sources 202*a* and 202*b* may be a UVLED-equipped ultraviolet light sources (UVLED irradiating means). Such light sources may allow various irradiating conditions to be flexibly and appropriately set for ultraviolet irradiation. A wavelength of ultraviolet light radiated from the light source 202*a*, 202*b* is not particularly limited insofar as the ink can be heated as described thus far and below. A suitable example of such ultraviolet wavelength may be less than or equal to 400 nm. How to irradiate the ink with ultraviolet light and effects thereby obtained will be described later in further detail.

The scan driver 14 drives the head unit 12 to perform scans in which the head unit 12 moves relative to the medium 50. Prompting the head unit 12 to perform scans is specifically prompting the inkjet heads 102*c-k* of the head unit 12 to perform the scans. In this embodiment, the scan driver 14 drives the head unit 12 to perform main and sub scans. The scan driver 14 prompts the head unit 12 to perform main scans, and the inkjet heads 102*c-k* of the head unit 12 eject the inks to each position on the medium 50. By moving the ultraviolet irradiator 104 with the inkjet heads 102*c-k* during the main scans, the ink on the medium 50 is irradiated with ultraviolet light from the ultraviolet irradiator 104 and thereby dried.

The scan driver 14 drives the head unit 12 to perform sub scans at intervals between the main scans, so that a position on the medium 50 facing the head unit 12 is sequentially shifted. The sub scan may refer to an operation in which the inkjet heads move relative to the medium 50 in the sub scanning direction orthogonal to the main scanning direction. In this embodiment, the scan driver 14 transports the medium 50 in a transport direction parallel to a direction illustrated as X-axis direction in the drawing and thereby prompts the head unit 12 to perform the sub scans. The medium 50 is transported in X+ direction illustrated in the drawing by, for example, a roller not shown.

The controller 20 is, for example, the CPU of the printing apparatus 10 that controls operations of the structural elements of the printing device 10. In each main scan, the controller 20 may prompt the inkjet heads 102*c-k* to eject the inks at timings suitably set for an image to be printed so as to render the image. The printing apparatus 10 of this embodiment thus configured may successfully print any desirable images.

In this embodiment, the printing apparatus 10 is a unidirectional printer that performs main scans in one direction alone which is Y+ direction illustrated in the drawing (printing direction). In the printing apparatus configured as illustrated in FIG. 1, the head unit 12 ejects C, M, Y, and K color inks as described earlier. In each main scan, the ink that just landed on the medium 50 is irradiated with ultraviolet light. In this manner, the ink may be prevented from bleeding, and a print result with a high resolution may be obtained. In a modified embodiment of the head unit 12, a clear ink, which is, for example, ink containing no colorant, may be further used. When such clear ink is used to form an overcoat layer, for example, it may be recommended to dry the ink after dots of the ink are sufficiently flattened over time, rather than drying the ink immediately after landing on the medium. In that case, the ink may be ejected in a main scan while the head unit 12 is moving forward in the Y+ direction, and the ejected ink may be irradiated with ultraviolet in the main scan while the head unit 12 is moving backward, heading back the initial position. In the unidirectional printer, a backward movement in the main scan may mean that the head unit 12 moves without ejecting the ink. This may provide enough time before ultraviolet irradiation starts and thereby allow the ink dots to be sufficiently flattened.

Specific features of the inks used in this embodiment and means for drying the inks are hereinafter described in detail. As described earlier, this embodiment uses, in the inkjet heads 102*c-k*, inks containing 20 wt. % or more of the low-boiling solvent and 20 wt. % or more of the high-boiling solvent. Optionally, these inks may contain solvents of three or more different types. In this instance, the high-boiling solvent and the low-boiling solvent (principal solvents) may be two solvents added to the ink in larger contents than the other solvent(s). Then, the ink preferably contains, among all of the solvents therein, 30 wt. % or more of the low-boiling solvent and 30 wt. % or more of the high-boiling solvent (in the total amount of all of the solvents).

The high-boiling solvent is preferably a solvent having a boiling point higher by 30° C. or more than the boiling point of the low-boiling solvent. More preferably, the boiling points of the high-boiling solvent and the low-boiling solvent differ by 40° C. or more. More specifically, in an exemplified ink (first type of ink), the boiling point of the low-boiling solvent may be a temperature lower than or equal to 110° C., and the boiling point of the high-boiling solvent may be a temperature higher than or equal to 130° C. In this instance, the low-boiling solvent may be, for example, water. The high-boiling solvent may be, for example, diethylene glycol. In another exemplified ink (second type of ink), the boiling point of the low-boiling solvent may be a temperature higher than or equal to 60° C. and lower than 100° C., and the boiling point of the high-boiling solvent may be a temperature higher than or equal to 100° C. In this instance, the low-boiling solvent may be selected from, for example, alcohols including ethyl alcohol. The high-boiling solvent may be selected from, for example, water, soybean oil, and diethylene glycols.

Such ink may be adequately dried under ultraviolet irradiation, as described later in detail. The high-boiling solvent and the low-boiling solvent at room temperature preferably have vapor pressures that substantially differ from each other. Taking for instance vapor pressures of these solvents at 25° C., the vapor pressure of the low-boiling solvent is preferably four or more times larger than that of the high-boiling solvent. The ink used in this embodiment increases in viscosity through evaporation of the low-boiling solvent from the ink. After 80% or more of the low-boiling solvent is evaporated from the ink of this embodiment, the ink has a degree of viscosity greater than or equal to 100 mPa·sec. The viscosity of the ink after 80% or more of the low-boiling solvent is evaporated is preferably greater than or equal to 500 mPa·sec, and is more preferably greater than or equal to 1,000 mPa·sec.

Figure 2:
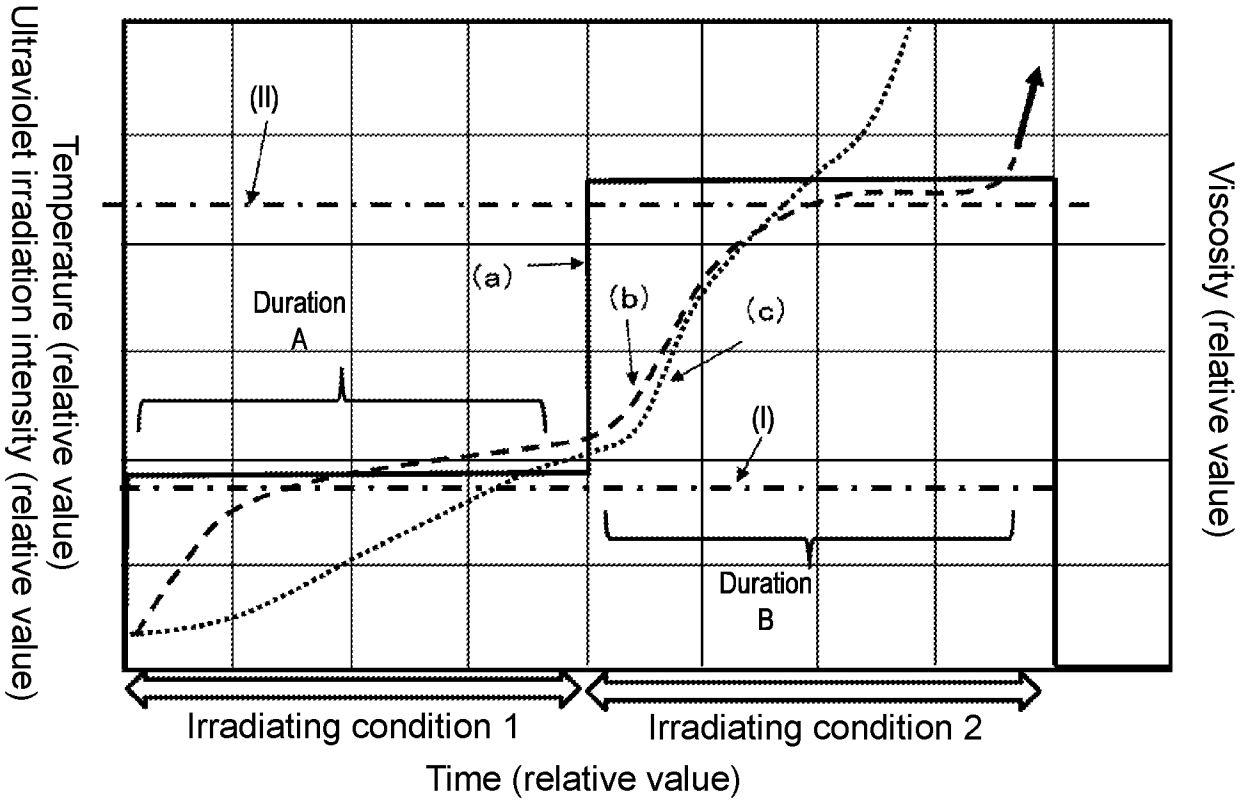
FIG. 2 is a detailed illustration of an ink drying means according to the embodiment.

FIG. 2 is a drawing that provides more detailed description of how to dry the inks used in this embodiment, graphically illustrating, by way of an example, states of the ink irradiated with ultraviolet light from the ultraviolet irradiator 104 (see FIG. 1). In this embodiment, as described earlier, the ultraviolet irradiator 104 radiates ultraviolet light from a respective one of the light sources 202*a* and 202*b* (see FIG. 1) and thereby allow one of the irradiating conditions 1 and 2 to be selected. Further, ultraviolet irradiation is performed under these conditions at different timings so that the ink is dried in two stages, as in durations A and B illustrated in the drawing.

In the graph of FIG. 2, a dashed line marked with (I) indicates the boiling point of the low-boiling solvent. A dashed line (II) indicates the boiling point of the high-boiling solvent. The duration A indicates a period of time when ultraviolet light is radiated under the irradiating condition 1 from the light source 202*a* of the ultraviolet irradiator 104. The duration B indicates a period of time when ultraviolet light is radiated under the irradiating condition 2 from the light source 202*b* of the ultraviolet irradiator 104. A solid line (a) indicates time-dependent changes in an intensity of ultraviolet light radiated from the ultraviolet irradiator 104. A broken line (b) indicates changes in temperature of the ink on the medium caused by ultraviolet irradiation of the ultraviolet irradiator 104. A broken line (c) indicates changes in viscosity of the ink.

As described earlier, the irradiating condition 1 is heating the ink on the medium so as to reach a temperature higher than or equal to the boiling point of the low-boiling solvent and lower than the boiling point of the high-boiling solvent. More specifically, an irradiation energy obtained from the product of the intensity of ultraviolet light and the duration A of ultraviolet irradiation at the intensity (irradiation time) is set so as to meet the irradiating condition 1. In the illustrated example of FIG. 2, the irradiation energy is set, so that the ink temperature exceeds the boiling point of the low-boiling solvent but stays below the boiling point of the high-boiling solvent in the final stage of a time frame corresponding to the duration A.

In the duration A, therefore, the low-boiling solvent may be adequately evaporated from the ink, with a reduced rate of evaporation of the high-boiling solvent. The occurrence of ink bleeding may be prevented by increasing the ink viscosity through evaporation of the low-boiling solvent immediately after the ink landed on the medium. In this stage, the high-boiling solvent still remains unevaporated in the ink. This may prevent bumping of the ink that possibly leads to explosive evaporation of the low-boiling solvent. In this instance, the ink viscosity does not suddenly increase but remains somewhat neutral, as illustrated with the broken line (c). As a result, the ink on the medium may be still wet enough to have the ink layer start to form a coating film or flatten by degrees over time. Thus, this embodiment may prevent that an ink surface becomes uneven, while preventing the occurrence of ink bleeding. Further, bumping of the ink may be prevented, which may prevent that the surface of the dried ink forms a porous coating film. This may provide such an effect that the ink layer surface is not roughened or become uneven. According to this embodiment, therefore, two effects may be both achievable; formation of an ink layer that excels in glossiness (flattened print layer), and prevention of ink bleeding. Further, banding, if any, may be unnoticeable in a print result by sufficiently flattening the ink dots. This embodiment, therefore, may obtain a print result improved in image quality.

The duration A may be regarded as a period of time when the low-boiling solvent is evaporated under ultraviolet irradiation meeting the irradiating condition 1 so as to prevent ink bleeding. The duration A is an example of at least part of a duration of time until all of the solvents in the ink are completely evaporated after the ink landed on the medium. The ink being irradiated with ultraviolet light under the irradiating condition 1 may be regarded as the ink being increased in viscosity by selectively evaporating the low-boiling solvent from the ink. The duration A is followed by the duration B in which ultraviolet light is radiated under the irradiating condition 2. In this embodiment, the irradiating condition 2 is, as described earlier, heating the ink on the medium so as to reach the temperature higher than or equal to the boiling point of the high-boiling solvent at a certain point in at least part of timings. In this embodiment, for example in the duration B, the ink may be heated to a temperature high enough to further evaporate the high-boiling solvent from the ink. Then, the solvents may be completely evaporated from the ink on the medium.

Completely evaporating the solvents from the ink may include sufficiently evaporating the solvents so as to thicken the ink to an adequately high viscosity. The duration B may be regarded as a period of time when the ink is dried and fixed to the medium by evaporating the high-boiling solvent. The high-boiling solvent may be difficult to evaporate as compared with the low-boiling solvent. Therefore, such an unfavorable event as bumping may be unlikely to occur during heating. By the time when the ultraviolet light is radiated under the irradiating condition 2, the ink dots are substantially flattened and spreading thin on the medium, and the solvent may be expected to more easily evaporate more evenly in a greater area on the medium. The ink surface may be difficult to become rough against the solvent evaporation when and after the high-boiling solvent starts to evaporate, or the ink surface may be difficult to become rough against the solvent evaporation because the ink has already been thickened to a certain degree of viscosity in the duration A. Therefore, the ink layer surface may be unlikely to become rough during ultraviolet irradiation under the irradiating condition 2.

In this embodiment, proportions of the low-boiling solvent and the high-boiling solvent in the ink (content ratios) are preferably optimized so as to prevent the ink bleeding, flatten the ink layer (coating film), and avoid the roughened ink surface to an extent that a demanded printing quality is obtainable. The graph of FIG. 2 shows a test result of ink containing, of the solvents added to the ink, 20 to 60 wt. % of the low-boiling solvent and 40 to 80 wt. % of the high-boiling solvent. The ink used in this test specifically contains 68 wt. % of the solvents, 12 wt. % of a pigment used as colorant, and 20 wt. % of a resin, in which 68 wt. % of the solvents was the total of 45 wt. % of the low-boiling solvent and 23 wt. % of the high-boiling solvent. After this ink is dried, the pigment becomes 37.5 wt. % (19 to 57 wt. %), and the resin becomes 62.5 wt. % (43 to 81 wt. %).

In this test using a UVLED irradiator having a luminous wavelength of 385 nm as the light source 202*a*, and ink containing an ultraviolet absorbent that effectively absorbs energy generated by UVLED light having a luminous wavelength between 250 nm and 400 nm, an amount of energy required of ultraviolet irradiation under the irradiating condition 1 may be approximately 0.1 to 1.0 J/cm$^2$. By thus radiating ultraviolet light, the ink may be thickened to a degree of viscosity that allows the low-boiling solvent to be sufficiently evaporated to an extent that the ink is preventing from bleeding. In this stage, the ink may be temporarily tacked to the medium. At the time, the ultraviolet irradiator 104 preferably evaporates 50% or more of the low-boiling solvent included in the ink on the medium by radiating ultraviolet light under the irradiating condition 1. As a result, the ink that just landed on the medium may be effectively increased in viscosity. At the time, 80 wt. % or more of the low-boiling solvent is more preferably evaporated from the ink. By thus evaporating most of the low-boiling solvent, the ink may be more effectively increased in viscosity.

An amount of energy required of ultraviolet irradiation under the irradiating condition 2 may be approximately 1 to 10 J/cm$^2$ when an ink layer (print layer) having the thickness of approximately 20 μm is formed at the resolution of 600×6001 dpi. The amount of energy required of ultraviolet irradiation under the irradiating condition 2 may be an amount of energy required of ultraviolet irradiation to heat the ink layer to a temperature higher than the boiling point of the high-boiling solvent and to almost fully dry the ink layer. In this embodiment, ultraviolet irradiation under the irradiating condition 2 in the duration B may substantially evaporate all of the solvents from the ink. As a result, the ink may be successfully dried and fixed to the medium. The amount of energy required of ultraviolet irradiation under the irradiating condition 2 may be smaller with a higher intensity of ultraviolet irradiation and accordingly shorter ink heating time. Heating the ink in a more adiabatic manner through shorter ultraviolet irradiation than a thermal time constant of the medium may reduce loss of heat dissipating through the medium. As a result, less energy of ultraviolet irradiation may be required to dry the ink.

In this embodiment, the largest value of energy of ultraviolet light radiated toward the ink on the medium (largest irradiation energy supplied) may be decided by an irradiation intensity and a time of the light source 202*a*, 202*b*. The largest irradiation energy supplied may need to be defined and set such that the ink and/or the medium is not burnt under printing conditions employed in the printing apparatus. The irradiation intensity and the time of ultraviolet light from the light source 202*a*, 202*b* is preferably changed automatically or manually by an operator based on such factors as printing speed, number of print passes, and density of ink dots formed on the medium (print dot density).

Figure 3:
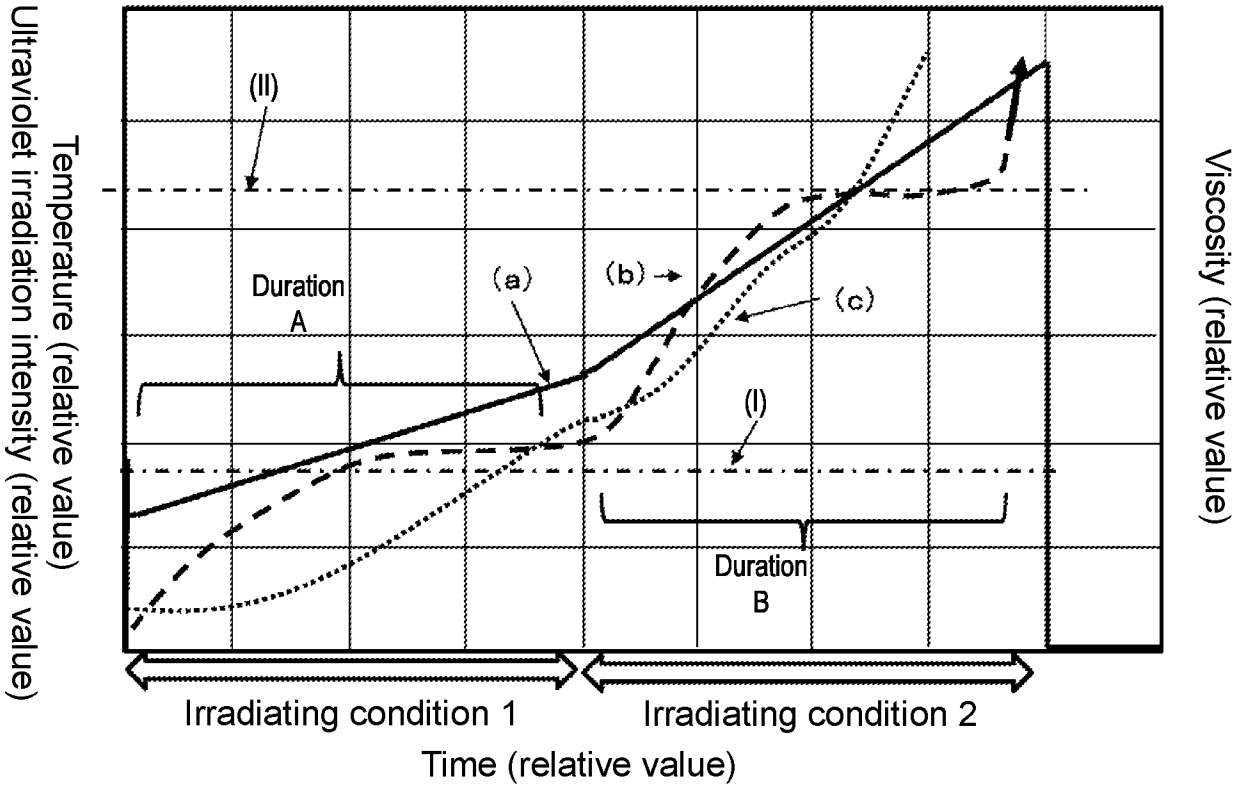
FIG. 3 is a detailed illustration of another ink drying means according to the embodiment.
Figure 4:
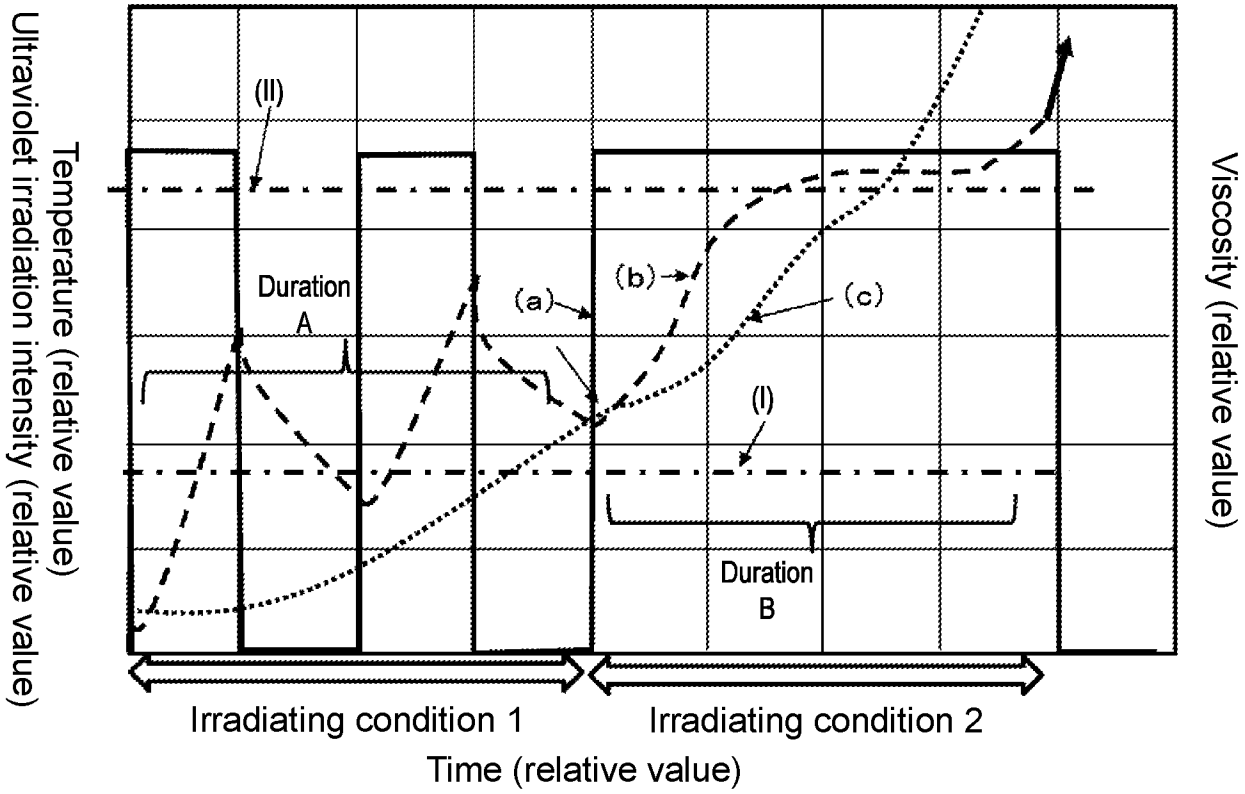
FIG. 4 is a detailed illustration of yet another ink drying means according to the embodiment.

The conditions set for ultraviolet irradiation (irradiating conditions 1 and 2) include but are not limited to what is illustrated in FIG. 2, and may be variously modified. FIGS. 3 and 4 are detailed illustrations of other ink drying means. These drawings illustrate, by way of an example, states of the ink irradiated with ultraviolet light in manners that differ from the example of FIG. 2. In FIGS. 3 and 4, lines and durations illustrated with the same reference signs as in FIG. 2 indicate the same lines and durations as illustrated in FIG. 2.

In the example of FIG. 3, the irradiating conditions 1 and 2 are so set that allow the intensity of ultraviolet light (irradiation intensity) to increase by degrees in the durations A and B, as illustrated with a solid line (a). Increase by degrees of ultraviolet irradiation intensity may be increase by degrees of ultraviolet irradiation intensity per unit time. A gradient of the irradiation intensity increase in each of the durations is preferably decided in view of, for example, boiling points of the low-boiling solvent and the high-boiling solvent, a width of ultraviolet irradiation (irradiation width) from the light source 202*a*, 202*b* of the ultraviolet irradiator 104 (see FIG. 1), and ultraviolet intensity distribution. According to this configuration, bumping of the solvent, for example, may be more easily avoided by changing a rate of increase of the irradiation intensity, while the ink on the medium may be changed in temperature and viscosity similarly to or in the same manner as described referring to FIG. 2. As a result, two effects may be both achievable; formation of an ink layer that excels in glossiness, and prevention of ink bleeding.

In the example of FIG. 4, pulsed ultraviolet light is radiated in the duration A as illustrated with a solid line (a), instead of radiating ultraviolet light of a constant intensity in both of the durations as illustrated in FIG. 2. This may allow for fine temperature control of the ink on the medium without causing overheating, as illustrated with the broken line (b) curve (temperature rising curve). Further, the ink on the medium may be changed in temperature and viscosity similarly to or in the same manner as described referring to FIG. 2. As a result, two effects may be both achievable; formation of an ink layer that excels in glossiness, and prevention of ink bleeding.

In the example of FIG. 4, pulsed ultraviolet light is radiated in the duration A alone. In a further modified embodiment of ultraviolet irradiating means, pulsed ultraviolet light may be radiated in the duration B as well as the duration A for certain printing requirements. As is clear from the description given earlier, ultraviolet irradiating means using the ultraviolet irradiator 104 should be decided and set in accordance with technical aspects of the printing apparatus. When the printing apparatus 10 is reconfigured, therefore, ultraviolet light may be radiated in a manner suitable for the reconfigured printing apparatus 10. Modified embodiments of the printing apparatus 10 are hereinafter described in further detail.

Figure 5:
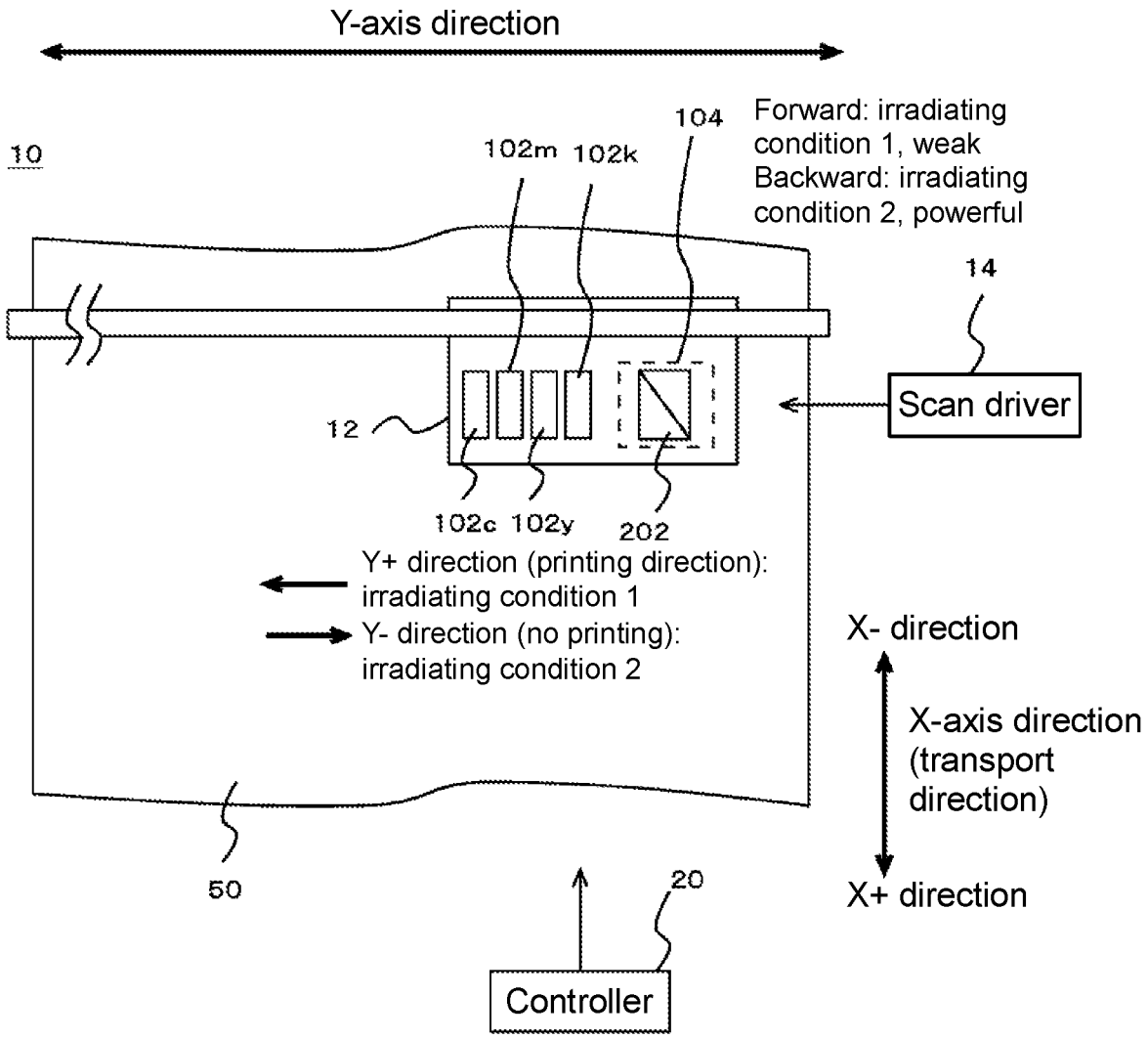
FIG. 5 is a drawing of principal structural elements, illustrated by way of an example, of a printing apparatus 10 according to a modified embodiment of this disclosure.

FIG. 5 is a drawing of principal structural elements, illustrated by way of an example, of a printing apparatus 10 according to a modified embodiment of this disclosure. Except for the additional features described below, the structural elements illustrated in FIG. 5 with the same reference signs as in FIGS. 1 to 4 may be identical or similar to the ones illustrated in FIGS. 1 to 4.

In this modified embodiment, the printing apparatus 10 is a unidirectional printer that performs main scans in one direction alone which is the Y+ direction illustrated in the drawing (printing direction), similarly to the printer 10 illustrated in FIG. 1. In this modified embodiment, the ultraviolet irradiator 104 has one light source 202 alone, instead of the light sources 202*a* and 202*b* illustrated in FIG. 1. The light source 202 irradiates the ink with ultraviolet light under irradiating conditions 1 and 2, as prompted by the controller 20. In other modified embodiments hereinafter described, the irradiating conditions 1 and 2 are similar or identical to the irradiating conditions described referring to FIGS. 1 to 4.

In this modified embodiment, the light source 202 radiates ultraviolet light under the irradiating condition 1 during a forward movement in each main scan. Radiating ultraviolet light during the forward movement in each main scan may mean radiating ultraviolet light during the movement of the head unit 12 in the Y+ direction in the drawing. The inks ejected from the inkjet heads 102*c-k* during the main scans are, immediately after landing on the medium 50, irradiated with ultraviolet light under the irradiating condition 1. Thus, the ink may be adequately increased in viscosity before starting to bleed on the medium. Further, bumping of the ink may be suitably prevented by irradiating the ink with relatively weak ultraviolet light under the irradiating condition 1.

Then, the ink is irradiated with ultraviolet light from the light source 202 under the irradiating condition 2 during a backward movement in each main scan, in which the head unit 12 moves back to the initial position after the main scan is over. Radiating ultraviolet light during the backward movement in each main scan may be specifically radiating ultraviolet light during the movement of the head unit 12 in Y− direction in the drawing. The ink thus prevented from bleeding during the forward movement is further irradiated with powerful ultraviolet light under the irradiating condition 2 and may be thereby adequately dried and fixed to the medium 50. In this modified embodiment, two effects may be both achievable as in the earlier embodiment; formation of an ink layer that excels in glossiness, and prevention of ink bleeding.

Figure 6:
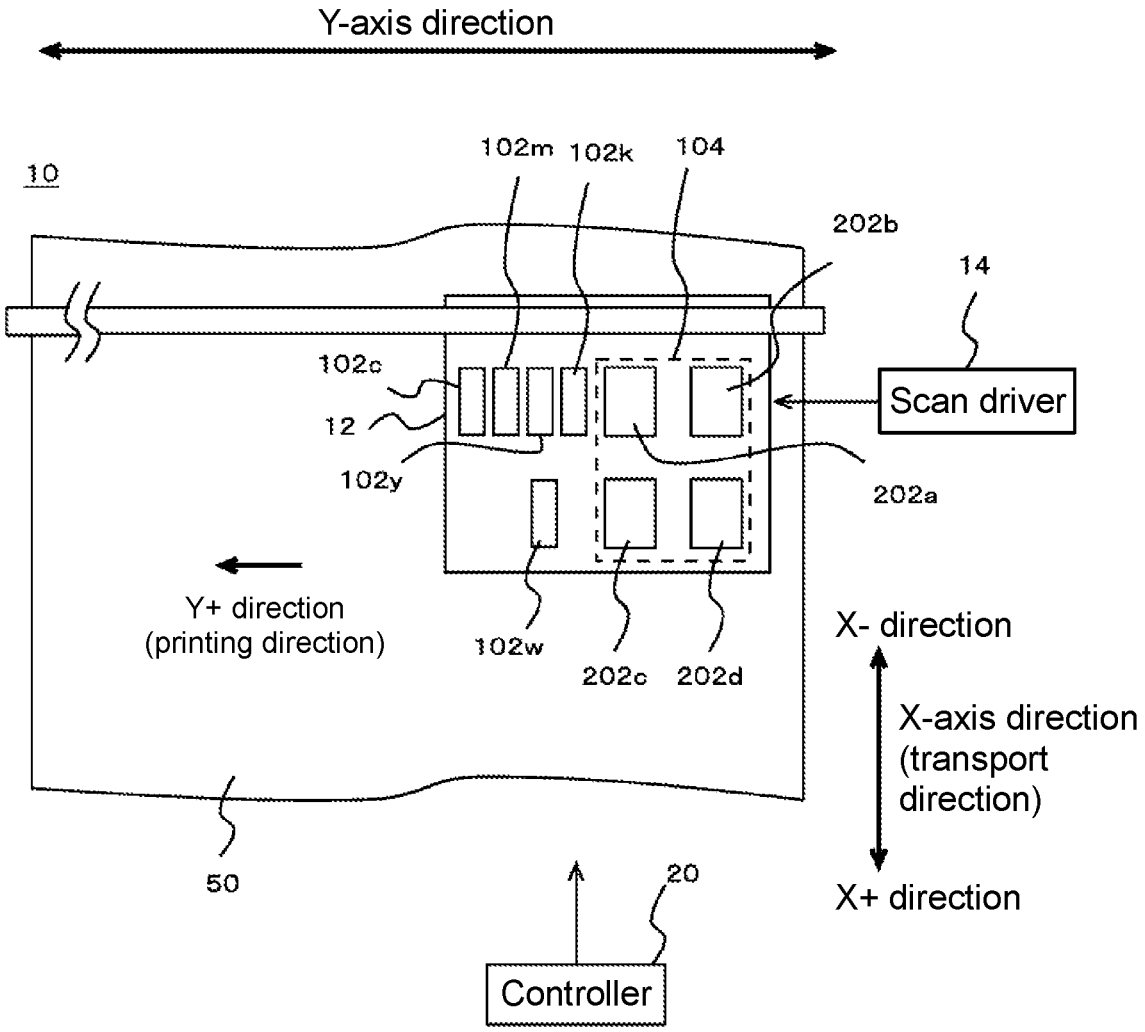
FIG. 6 is a drawing of principal structural elements, illustrated by way of an example, of a printing apparatus 10 according to another modified embodiment of this disclosure.

The printing apparatus 10 may be structurally further modified. FIG. 6 is a drawing of principal structural elements, illustrated by way of an example, of a printing apparatus 10 according to another modified embodiment of this disclosure. Except for the additional features described below, the structural elements illustrated in FIG. 6 with the same reference signs as in FIGS. 1 to 5 may be identical or similar to the ones illustrated in FIGS. 1 to 5.

In this modified embodiment, the printing apparatus 10 is a unidirectional printer that performs main scans in one direction alone which is the Y+ direction illustrated in the drawing (printing direction), similarly to the printer 10 illustrated in FIG. 1. In this modified embodiment, the head unit 12 further includes an inkjet head 102*w* in addition to the inkjet heads of the head unit 12 illustrated in FIG. 1. The inkjet head 102*w* ejects white color ink and is displaced from the inkjet heads 102*c-k* in the sub scanning direction.

In the head unit 12 according to this modified embodiment, a plurality of inkjet heads may be separately arranged in different rows. The inkjet head 102*w* is an example of inkjet heads for feature colors. In yet another modified embodiment of the printing apparatus 10, the feature color inkjet head in the head unit 12 may be, instead of the inkjet head 102*w*, an inkjet head for any other color, for example, inkjet head for clear ink.

In this modified embodiment, the ultraviolet irradiator 104 is further equipped with a plurality of light sources 202*c* and 202*d* in addition to the light sources of the ultraviolet irradiator 104 illustrated in FIG. 1. The light sources 202*c* and 202*d* are provided correspondingly to the inkjet head 102*w*. The light source 202*c* radiates ultraviolet light under the irradiating condition 1, similarly to the light source 202*a*.

The light source 202*d* radiates ultraviolet light under the irradiating condition 2, similarly to the light source 202*b*. In the printing apparatus according to this modified embodiment in which part of the inkjet heads is displaced from the other inkjet heads in the sub scanning direction, the inks ejected from the inkjet heads may be favorably irradiated with ultraviolet light under the irradiating conditions 1 and 2. As a result, two effects may be both achievable; formation of an ink layer that excels in glossiness, and prevention of ink bleeding.

For certain applications of a printed matter, it may be preferable to dry a particular color ink(s) in a manner that differs from the other color inks. When the feature color ink is clear ink and used to form an overcoat layer on a color ink layer, the clear ink layer may desirably be as transparent and flat as possible. To this end, the clear ink may be dried in a manner that differs from the color inks. For example, the clear ink may be left unirradiated with ultraviolet light immediately after landing on the medium, or the clear ink may be irradiated with ultraviolet light after the passage of time long enough to sufficiently flatten the ink dots. In this instance, an inkjet head for clear ink may be used instead of the inkjet head 102*w* in the structure illustrated in FIG. 6. Similarly to or in the same manner as described earlier, the color inks ejected from the inkjet heads 102*c-k* are irradiated with ultraviolet light from the light source 202*a* immediately after landing on the medium during the forward movement in each main scan. On the other hand, ultraviolet irradiation may be selectively not performed during the forward movement in each main scan for the clear ink ejected from the clear ink inkjet head, in which case the clear ink is irradiated with ultraviolet light from the light sources 202*c* and 202*d* during the backward movement in each main scan. Then, the clear ink may be dried after the ink dots are sufficiently flattened. For example, ultraviolet radiation from the light source 202*d* may be performed under the irradiating condition 1, while ultraviolet radiation from the light source 202*c* may be performed under the irradiating condition 2. In this manner, the clear ink on the medium 50 may be first irradiated with ultraviolet light under the irradiating condition 1 and then irradiated with ultraviolet light under the irradiating condition 2.

The description given thus far mostly focuses on the printing apparatus 10 adapted for unidirectional printing. In the printing apparatus of this type, ultraviolet light is continuously radiated from the light sources disposed on one side of the inkjet heads 102*c-k* in the head unit 12 under the irradiating conditions 1 and 2, as illustrated in FIGS. 1, 5, and 6. As illustrated in FIGS. 1 and 6, the light sources respectively for the irradiating conditions 1 and 2 may be separately disposed at different positions. In this instance, positions of the light sources are preferably adjusted so as to meet requirements of ultraviolet irradiation timings, lengths of irradiation time, and irradiation time intervals of the respective light sources. In a modified embodiment of the head unit 12, one light source may be divided into a front-side light source and a rear-side light source which are operable under different driving conditions depending on a region of the medium to be printed, and these divided light sources may be operated similarly to a plurality of light sources. As illustrated referring to FIG. 5, one light source may be used for ultraviolet irradiation under the irradiating conditions 1 and 2 both in accordance with the operation of the printing apparatus 10.

The printing apparatus 10 may be a bidirectional printer. The bidirectional printer refers to a printer configured to perform main scans in one direction and in the other direction parallel to the main scanning direction. The light sources constituting the ultraviolet irradiator 104 may be disposed on both sides, instead of one side, of the inkjet heads 102*c-k* in the main scanning direction.

Figure 7A:
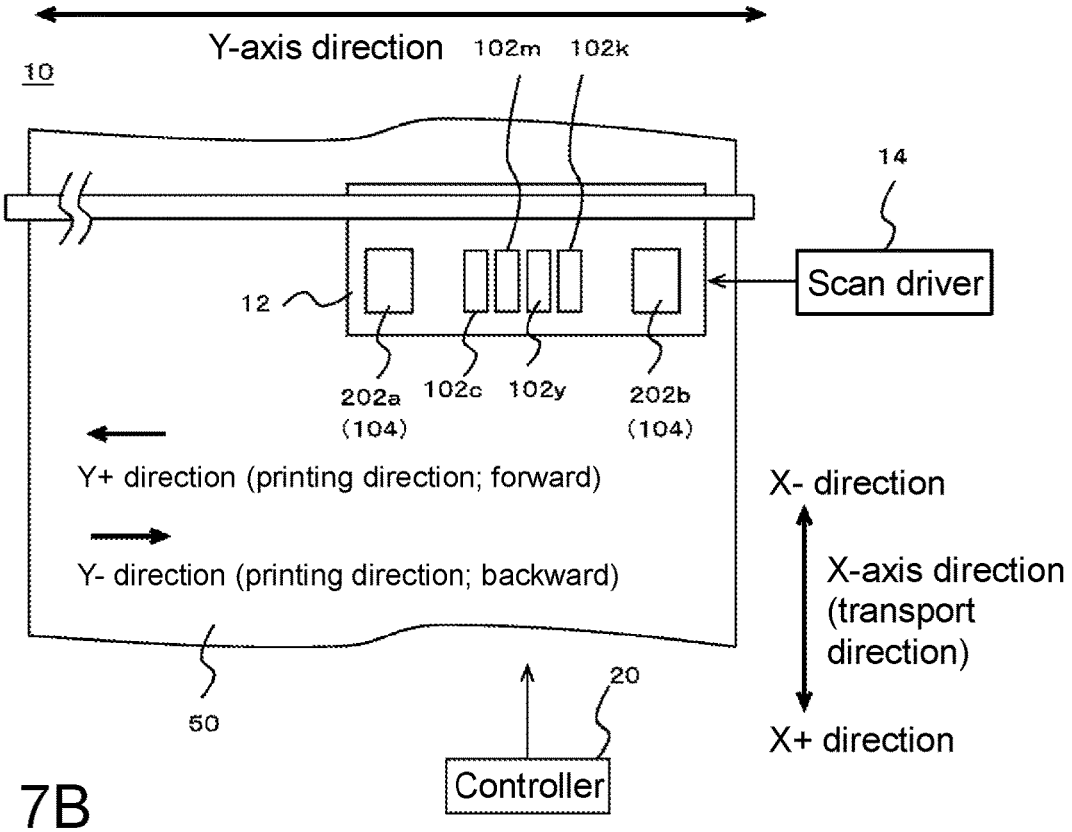
FIGS. 7A and 7B are drawings of a printing apparatus 10 according to yet another modified embodiment of this disclosure.
Figure 7B:
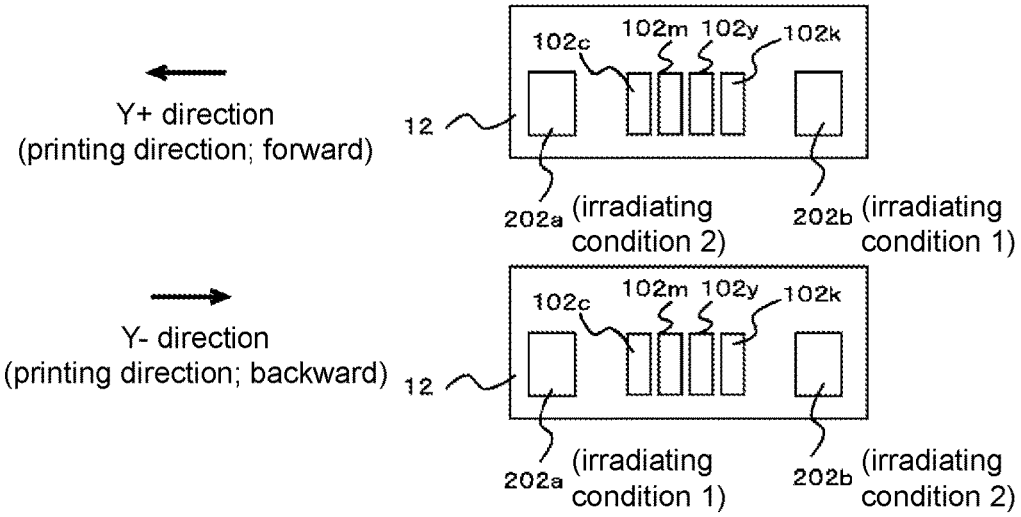

FIG. 7 are drawings of a printing apparatus 10 according to yet another modified embodiment of this disclosure. FIG. 7A is a drawing of principal structural elements, illustrated by way of an example, of the printing apparatus 10. FIG. 7B is a drawing of conditions for ultraviolet irradiation using light sources 202*a* and 202*b* of the ultraviolet irradiator 104. Except for the additional features described below, the structural elements illustrated in FIG. 7 with the same reference signs as in FIGS. 1 to 6 may be identical or similar to the ones illustrated in FIGS. 1 to 6.

In this modified embodiment, the printing apparatus 10 is a bidirectional printer that performs main scans in two directions; Y+ direction (forward printing direction) and Y− direction (backward printing direction) illustrated in the drawing. A main scan in two directions may include a main scan in which the inkjet head ejects ink while moving forward, and a main scan in which the inkjet head ejects ink while moving backward. In the head unit 12 of this modified embodiment, the light sources 202*a* and 202*b* of the ultraviolet irradiator 104 are disposed at positions that differ from the light sources in the head unit 12 illustrated in FIG. 1.

In this instance, ultraviolet irradiating conditions of the light sources 202*a* and 202*b* may be set differently depending on the direction of movement of the head unit 12 during main scans, as illustrated in FIG. 7B. More specifically, in the main scan in which the head unit 12 moves forward in the Y+ direction, ultraviolet light is radiated from the light source 202*b* behind the inkjet heads 102*c-k* in the direction of movement under the irradiating condition 1, as illustrated on the upper side in FIG. 7B. Then, the low-boiling solvent may be evaporated from the ink that just landed on the medium, and a risk of ink bleeding may be accordingly prevented. On the other hand, the light source 202*a* ahead of the inkjet heads 102*c-k* in the direction of movement of the head unit 12 radiates ultraviolet light under the irradiating condition 2. At the time, the light source 202*a* does not radiate ultraviolet light toward the ink that landed on the medium in a current main scan (forward movement) but radiates ultraviolet light toward the ink that landed on the medium in an earlier main scan (for example, backward movement in a previous main scan). In this manner, the light source 202*a*, in order to evaporate the high-boiling solvent from the ink, radiates ultraviolet light toward the ink already irradiated with ultraviolet light from the light source 202*b* from which the low-boiling solvent has been evaporated.

In each main scan, the ultraviolet irradiating conditions set for the light sources 202*a* and 202*b* are reversed when the head unit 12 moves backward in the Y− direction which is opposite to the forward movement. Specifically, ultraviolet light is radiated from the light source 202*a* under the irradiating condition 1 and is radiated from the light source 202*b* under the irradiating condition 2, as illustrated on the lower side in FIG. 7B. According to this configuration, the ink on the medium 50 may be suitably irradiated with ultraviolet light under the irradiating conditions 1 and 2 during the forward and backward movements in each main scan. In this modified embodiment, two effects may be both achievable as in the earlier embodiment; formation of an ink layer that excels in glossiness, and prevention of ink bleeding.

In this modified embodiment, the ink that landed on the medium 50 in a current one of the main scans is irradiated with ultraviolet light under the irradiating condition 2 in a next one of the main scans. In the head unit 12, therefore, a width of the light source 202*a*, 202*b* in the sub scanning direction is preferably greater than a width of the inkjet heads 102*c-k* in regard to the sub scans performed at intervals between the main scans. Specifically, the width of the light sources 202*a* and 202*b* in the sub scanning direction is preferably increased toward the downstream side in the transport direction of the medium 50 by a dimension greater than or equal to an amount of feed in the sub scanning direction. Thus, bidirectional main scans may be more favorably performed.

Hereinafter, additional remarks are given in relation to the technical aspects described thus far. To simplify the description given below, the structural and technical features described thus far referring to FIGS. 1 to 7 are collectively referred to as "this example".

In this example, the ink ejected to and landing on the medium is irradiated with ultraviolet light and thereby dried. By converting ultraviolet energy into thermal energy, the solvents may be sufficiently evaporated from the ink in short time. An example of the ink used in this example, therefore, may be an instantaneous drying ink that can be instantaneously dried through ultraviolet-used solvent evaporation (UV instantaneous drying ink). In this example, mediums conventionally difficult to be use for printing applications because of a higher risk of ink bleeding may be used as print mediums more effectively by using such instantaneous drying inks. For example, mediums difficult to use with the conventional evaporation-drying inks such as solvent inks, aqueous inks, latex inks, and emulsion inks may be directly and suitably used for printing applications.

Such mediums conventionally difficult to use may include permeable mediums, such as paper and fabric, on which ink is very likely to bleed and run. Examples of the fabric mediums may include unprocessed fabrics and sewn products such as T-shirts. Non-permeable mediums (for example, plastic films, vinyl chloride sheets) may also be used. The occurrence of ink bleeding may be effectively prevented with such mediums by drying ink in short time. Other than the mentioned examples, various mediums may also be used, which may include mediums with no bleeding-preventive layer formed thereon. According to this example, therefore, a medium-free printing apparatus that can accept various types of mediums may be successfully provided. Such printing apparatus may be improved in printing speed because of a reduced risk of ink bleeding. The printing apparatus in this example, therefore, may effectuate high-speed printing using various types of mediums. Examples of the printing apparatus may include high-speed printers adapted for various printing techniques ranging from one-pass printing to multi-pass printing.

This example, as described so far, does not simply address the issue of ink bleeding but deals with the risk of the ink layer being roughened by bumping of the ink, allowing an ink layer that excels in glossiness to be successfully formed. Therefore, high-quality print results may be more effectively obtained with inks involving a high risk of surface roughening under ultraviolet irradiation alone. An example of such inks may be a type of ink that leaves resin on the medium after being dried. In this instance, the surface of resin remaining on the medium may be roughened when the ink is irradiated with powerful ultraviolet light in short time to be instantaneously dried. As a result, a glossy print result may be difficult to obtain. In this example, roughening the resin surface may be avoidable even when such ink is used, and desirable glossiness may be accordingly imparted to a printed matter. When a resin-containing ink is used with a fabric medium, for example, the ink may be firmly fixed to the medium. This may allow a printed matter to improve in abrasion resistance and fastness to wash.

When ink containing a pigment as colorant is used, for example, the pigment may be unfavorably disturbed when the ink is irradiated with powerful ultraviolet light in short time to be instantaneously dried. As a result, a glossy print result may be difficult to obtain. When such ink is used and then dried slowly, pigment particles may be likely to gather in edges of ink dots and an image being formed that are more quickly dried than the other parts, which may result in a coffee stain effect. Then, an image obtained may have a lower mean concentration or may have a roughened surface due to ununiformly dispersed pigment, which may result in a poor image quality. These issues may be more noticeable with mediums on which inks make smaller angles of contact, for example, non-permeable mediums including plastic films. In this example, however, the ink may be adequately increased in viscosity immediately after landing on the medium to an extent that the ink is not fully dried. Thus, the before-mentioned issues may be overcome, and even pigment-containing ink may be fixed more reliably to the medium.

When the ink is dried under ultraviolet irradiation as described in this example, power consumption may be significantly decreased, as compared with use of a heater that generates heat and thereby heats the medium. Specifically, power consumption on average may be decreased to a fraction of that of the heater-used conventional means, and standby consumption may drop to zero. This example may facilitate heat release as compared with the heater-used conventional means and may accordingly provide a downsized and/or lower-priced printing apparatus 10.

The ink drying means in this example may be considered to instantaneously dry the ink under ultraviolet irradiation performed in a time-sharing manner by setting different irradiating conditions (time-sharing instantaneous drying means). The embodiments described earlier mainly employ two ultraviolet irradiating conditions; irradiating condition 1, and irradiating condition 2. However, three or more irradiating conditions may be used and set, in which the irradiating conditions 1 and 2 are preferably at least included, so that the ink is adequately dried ink under ultraviolet irradiation.

The description given so far to the printing apparatus 10 mostly focuses on a serial printer that prompts the head unit 12 to perform main scans. The printing apparatus 10, however, may be a line printer insofar as ultraviolet irradiation can be exercised under the irradiating conditions 1 and after the ink landed on the medium. In this instance, the ultraviolet irradiator may be disposed downstream relative to the inkjet heads in the transport direction of the medium and prompted to radiate ultraviolet light under different irradiating conditions. In the printing apparatus configured as a line printer, ultraviolet irradiators may be separately or collectively disposed downstream relative to the inkjet heads in the transport direction of the medium correspondingly to different color inks.

The printing apparatus 10 may be equipped with a heater as another ink drying means in addition to the ultraviolet irradiator. The heater is a heating means that generates heat and thereby heats the medium. The heater may be regarded as a heating means that heats the medium and dries the ink indirectly through the heated medium or a heating means that generates thermal energy and heats the medium by feeding the medium with the generated thermal energy. When a heater used, the heater heats the medium subsequent to ultraviolet irradiation under the irradiating condition 1. Such a heater may be regarded as an after-heating means to fully dry the ink.

In a further modified embodiment of the printing apparatus 10, any other heating means but ultraviolet irradiation may be employed to fully dry the ink. In this instance, the ink may be irradiated with ultraviolet light under the irradiating condition 1 alone, and then heated by one or more selected from various heaters, instead of ultraviolet irradiation under the irradiating condition 2. This may also be an effective means for evaporating the high-boiling solvent included in the ink to an extent that the ink is fixable to the medium.

Though not described in detail so far, ultraviolet light having the same wavelength may be used in the irradiating conditions 1 and 2. For certain printing requirements, ultraviolet light having different wavelengths (for example, peak wavelengths) may be used for the irradiating condition 1 and the irradiating condition 2. For example, ultraviolet light having a wavelength that further penetrates into ink dots (wavelength A) may be used for the irradiating condition 1 which is set first to irradiate the ink on the medium with ultraviolet light, and ultraviolet light having a wavelength more easily absorbed in the vicinity of the ink surface (wavelength B) than ultraviolet light of the wavelength A may be used for the irradiating condition 2 which is set subsequent to the condition 1. So far, ultraviolet irradiation was described as an example of the energy line-used drying means. In a further modified embodiment of the printing apparatus 10, any suitable energy line but ultraviolet light (for example, infrared light) may be used. Specific structural features of the printing apparatus 10 are not necessarily configured as described thus far but are variously modifiable. For example, the printing inks may be inks having any other colors but the described colors, for example, various feature color inks such as RGB color inks, and/or metallic color and/or pearl color inks.

What is claimed is:

1. A printing apparatus that performs inkjet printing using a medium, the printing apparatus comprising:

an inkjet head that ejects ink to the medium, the ink including solvents of at least two types having boiling points that differ from each other; and an energy line irradiator that irradiates the ink on the medium with the energy line so as to heat the ink, wherein the solvents including a low-boiling solvent and a high-boiling solvent having a higher boiling point than the low-boiling solvent, wherein the ink including 20 wt. % or more of the low-boiling solvent and 20 wt. % or more of the high-boiling solvent, and wherein the energy line irradiator irradiates the ink on the medium with the energy line in at least part of a duration of time until the solvents in the ink are completely evaporated after the ink land on the medium, so that a temperature of the ink on the medium increases to a degree higher than or equal to the boiling point of the low-boiling solvent and lower than the boiling point of the high-boiling solvent.

2. The printing apparatus according to claim 1, wherein the energy line irradiator irradiates the ink on the medium with the energy line under a first condition and a second condition until the solvents in the ink are completely evaporated after the ink land on the medium, the first condition is heating the ink on the medium so as to reach a temperature higher than or equal to the boiling point of the low-boiling solvent and lower than the boiling point of the high-boiling solvent, the second condition is heating the ink on the medium so as to reach a temperature higher than or equal to the boiling point of the high-boiling solvent, the energy line irradiator irradiates the ink on the medium with the energy line under the first condition so as to evaporate 50% or more of the low-boiling solvent included in the ink, and subsequent to the energy line irradiation under the first condition, the energy line irradiator irradiates the ink on the medium with the energy line under the second condition.

3. The printing apparatus according to claim 1, wherein the boiling point of the high-boiling solvent is higher by 30° C. or more than the boiling point of the low-boiling solvent.

4. The printing apparatus according to claim 3, wherein the boiling point of the low-boiling solvent is lower than or equal to 110° C., and the boiling point of the high-boiling solvent is higher than or equal to 130° C.

5. The printing apparatus according to claim 3, wherein the boiling point of the low-boiling solvent is higher than or equal to 60° C. and lower than 100° C., and the boiling point of the high-boiling solvent is higher than or equal to 100° C.

6. The printing apparatus according to claim 1, wherein the low-boiling solvent at 25° C. has a vapor pressure four or more times larger than a vapor pressure of the high-boiling solvent at 25° C.

7. The printing apparatus according to claim 1, wherein the ink has a degree of viscosity greater than or equal to 100 mPa·sec after 80% or more of the low-boiling solvent included in the ink is evaporated.

8. The printing apparatus according to claim 1, wherein, in at least part of the duration of time, the energy line irradiator irradiates the ink on the medium with the energy line so that the ink is increased in viscosity to an extent that the ink does not bleed on the medium but is allowed to flatten over time.

9. The printing apparatus according to claim 1, wherein the ink is a type of ink that leaves resin on the medium after being dried.

10. The printing apparatus according to claim 1, wherein the ink includes a pigment as colorant.

11. The printing apparatus according to a claim 1, wherein the energy line irradiator radiates ultraviolet light as the energy line.

12. The printing apparatus according to claim 11, wherein the energy line irradiator uses a UVLED as an ultraviolet irradiating means.

13. A printing method for performing inkjet printing on a medium, comprising:

ejecting ink from an inkjet head to the medium, the ink including solvents of at least two types having boiling points that differ from each other; and irradiating the ink on the medium with energy line so as to heat the ink, wherein the solvents including a low-boiling solvent a high-boiling solvent having a higher boiling point than the low-boiling solvent, wherein the ink including 20 wt. % or more of the low-boiling solvent and 20 wt. % or more of the high-boiling solvent, wherein the ink on the medium is irradiated with the energy line in at least part of a duration of time until the solvents in the ink are completely evaporated after the ink land on the medium, so that a temperature of the ink on the medium increases to a degree higher than or equal to the boiling point of the low-boiling solvent and lower than the boiling point of the high-boiling solvent.

* * * * *